US007040560B2

(12) United States Patent
Jørgensen

(10) Patent No.: US 7,040,560 B2
(45) Date of Patent: May 9, 2006

(54) ROTOR FOR HAMMER-OR CHOPPER MILL

(75) Inventor: Henning Jørgensen, Kolding (DK)

(73) Assignee: Sprout-Matador A/S, (DK)

( * ) Notice: Subject to any disclaimer, the term of this patent is extended or adjusted under 35 U.S.C. 154(b) by 18 days.

(21) Appl. No.: 10/466,427

(22) PCT Filed: Jan. 15, 2002

(86) PCT No.: PCT/DK02/00025

§ 371 (c)(1),
(2), (4) Date: Nov. 7, 2003

(87) PCT Pub. No.: WO02/057018

PCT Pub. Date: Jul. 25, 2002

(65) Prior Publication Data

US 2004/0113001 A1 Jun. 17, 2004

(30) Foreign Application Priority Data

Jan. 16, 2001 (DK) ..... 2001 00072

(51) Int. Cl.
*B02C 13/26* (2006.01)

(52) U.S. Cl. ..... 241/194; 241/294

(58) Field of Classification Search ..... 241/194, 241/195, 294
See application file for complete search history.

(56) References Cited

U.S. PATENT DOCUMENTS

| | | | | |
|---|---|---|---|---|
| 3,252,276 A * | 5/1966 | Brewer | ..... | 56/289 |
| 3,645,459 A | 2/1972 | Lucas et al. | | |
| 5,320,292 A | 6/1994 | Smith | | |

FOREIGN PATENT DOCUMENTS

| | | |
|---|---|---|
| EP | 1 127 620 | 8/2001 |
| GB | 1 569 376 | 6/1980 |

* cited by examiner

*Primary Examiner*—Mark Rosenbaum
(74) *Attorney, Agent, or Firm*—Stites & Harbison PLLC; Marvin Petry

(57) ABSTRACT

In a rotor construction for hammer- or chopper mills the rotor is formed by a cylindrical shell structure (2) transversally profiled for providing a drum surface comprising at least one longitudinally extending recess (6) for accommodation of base portions of chopper members. In the rotor construction the at least one recess (6) is provided with chopper positioning means (8, 18) at fixed locations for lateral stabilisation of said base portions and for stable accommodation of shaft members (12) for pivotable attachment of said chopper members (14).

8 Claims, 2 Drawing Sheets

ROTOR FOR HAMMER-OR CHOPPER MILL

TECHNICAL FIELD

The present invention relates to a rotor construction for application in a hammer- or chopper mill.

DESCRIPTION OF PRIOR ART

A rotor for a hammer- or chopper mill is a roller unit which has often been implemented as a stack or packet of circular supporting plates longitudinally spaced by means of interposed circular spacers of lesser diameter than the supporting plates. Radially external each of these spacers there is thus formed a circumferential groove between adjacent, opposite supporting plates and within these grooves there are accommodated the base portions of radially outwardly extending chopper members that are pivotally attached to longitudinally extending shaft members, extending through suitably positioned apertures in said supporting plates. The outwardly extending chopper members co-operate with a surrounding sieve basket.

It has been acknowledged within the art that the above rotor construction suffers from a number of disadvantages, the construction for instance being unnecessarily heavy, and modifications of the applied plate members have therefore been suggested. It has, however, also been suggested completely to abandon the above "plate concept" and replace it with a rotor structure based on a cylindrical shell structure, transversally profiled to form a drum: the circumferential surface of which is provided with suitable attachment means for a plurality of chopper members.

Thus DE 26 22 242 discloses a rotor for a hammer mill, the rotor being of the above mentioned shell structure, where the circumferential wall of the rotor is provided with cut-outs for providing passage to internal compartments attached to the inner shell surface, which cut-outs and corresponding compartments are dimensioned for accommodation of a single chopper member in each compartment. The disclosed rotor is provided with a number of such cut-outs and compartments placed at fixed positions along the circumferential surface of the rotor, thus predetermining the maximal number and positions of chopper members over the circumferential surface of the rotor.

DISCLOSURE OF THE INVENTION

According to the preceding description of a prior art rotor construction for a chopper mill it is an object of the present invention to provide a rotor construction likewise based on a shell structure but provided with simpler and yet more flexible means for attachment of the chopper members to the shell structure of the rotor.

These and other objects are attained with a rotor construction according to claim 1. Various embodiments of this construction are defined in the dependent claims.

According to the present invention there is thus provided a rotor for a hammer- or chopper mill comprising a cylindrical shell structure forming a circumferential drum surface for rotation about the longitudinal axis through said cylindrical shell structure, where said circumferential drum surface comprises at least one longitudinally extending recess for accommodation of a base portion of a plurality of chopper members.

According to one embodiment of the rotor construction said at least one recess extends longitudinally over the entire length of said drum surface, but it is understood that all or some of said recess(es) may extend over less than the total length of the drum surface of the rotor.

In said at least one recess chopper positioning means comprising attachment and laterally stabilising members for said base portions of the chopper members can be provided for a stable accommodation of said shaft members, which members may even be replaced by gudgeons laterally extending from corresponding adjacent attachment and stabilising members. Two important objects will be attained by these attachment and stabilising members, namely said lateral stabilisation of the chopper members and furthermore the formation of circumferential fillings of said recesses in the gabs between the chopper members, whereby the accumulation of grinding material in said gabs is prevented, which accumulation would result in reduced efficiency of the chopper mill.

An advantageous effect of the rotor construction according to the present invention is that it is possible to avoid the above mentioned heavy construction based on the "packet concept" and yet obtain a rotor construction which can be made mechanical stable (rigid), even though the shell structure of the cylindrical drum is made from a comparatively thin sheet of material, said at least one longitudinally extending recesses contributing substantially to the overall stability of the shell structure. The shell structure can furthermore be stabilised by a number of radially extending fastening means internally connecting the drum with a central drive shaft extending longitudinally through the drum. Said fastening means could preferably be provided by a number of radially extending wing plates, although other means would be evident to a person skilled in the art.

BRIEF DESCRIPTION OF THE DRAWINGS

The invention will now be described in more detail with reference to the accompanying drawings, in which.

DETAILED DESCRIPTION OF THE INVENTION

In the following a detailed description of two embodiments of the rotor construction according to the invention is given.

Figure 1:
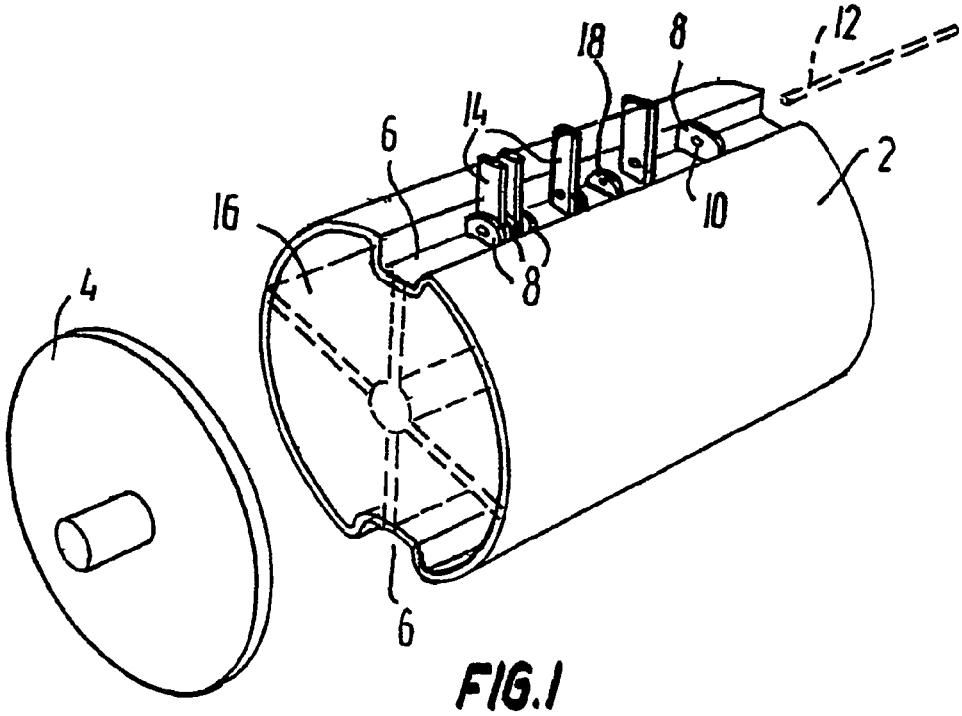
FIG. 1 is a perspective view of the main elements of a rotor for a chopper mill accordant to the present invention.
Figure 2:
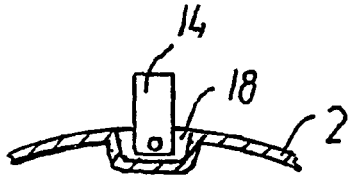
FIGS. 2 to 3 shows various details of the rotor shown in FIG. 1.

With reference to FIG. 1 there is shown a shroud 2, preferably made of steel sheet provided with corresponding end portions 4. The shroud 2 is profiled with a pair al longitudinally extending recesses 6, wherein a number of laterally positioned fastening plates 8 are secured, said fastening plates being provided with apertures 10 for accommodation of a longitudinally extending staybar 12. In the gabs formed between the plates 8 there are pivotably attached a series of radially outwardly extending chopper members 14 provided with base holes for reception of said staybar 12. The shroud 2 is stabilised by means of radially extending wing plates 16 between the inner wall of the shroud 2 and the extension 19' of a central drive shaft 19.

Figure 3:
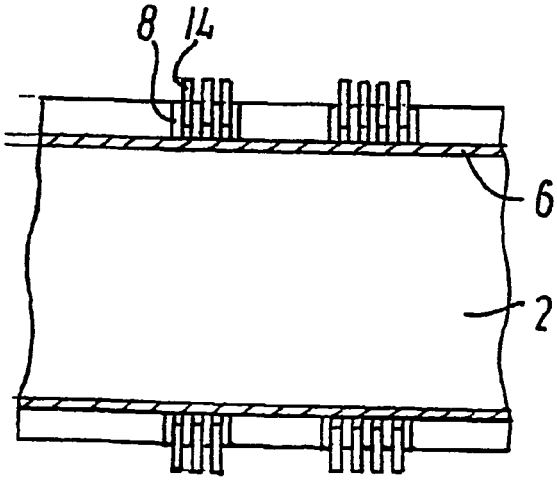

Referring to FIG. 3 the series of chopper members 14 of the two opposite recesses 6 shown in FIG. 1 are longitudinally displaced relative to each other, whereby the two series of chopper members 14 will sweep substantially the complete surface area of the surrounding sieve basket (not shown in the figure).

According to one embodiment of the invention some of the fastening plates 8 may be replaced by spacers 18 of a lesser radial extension for providing lateral support of the chopper members 14 radially internal of the staybar 12, thereby facilitating mounting of the chopper members 14 on the rotor.

Figure 4:
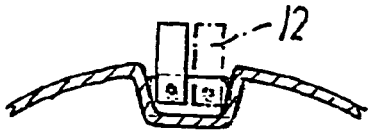
FIGS. 4 to 6 shows details of an alternative embodiment of the present invention.
Figure 5:
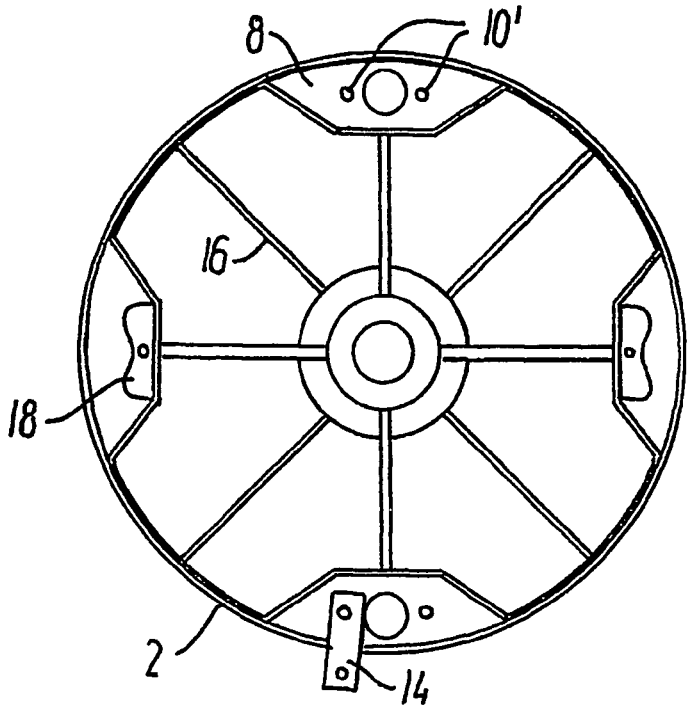
Figure 6:
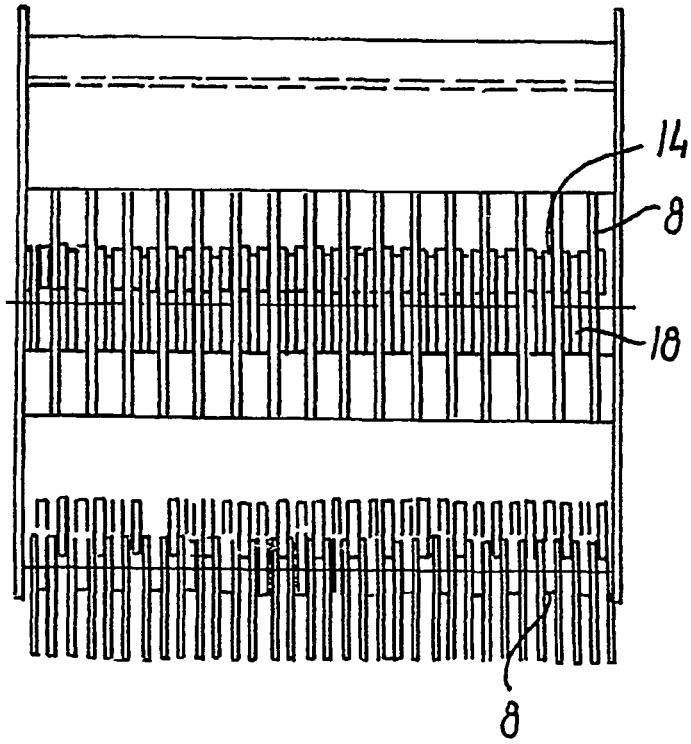

In practice reversible chopper members 14 are often preferable. Referring to FIGS. 4, 5 and 6 such chopper members are provided with suitable apertures at both ends hereof and can be rotated around a staybar 12 passed through one of said apertures to a position substantially tangentially to the surface of the drum, in which position said apertures at the other end of the chopper member becomes aligned with apertures 10' for reception of a second staybar 12'. When this staybar 12' has been inserted through the chopper member the first staybar 12 may be removed, whereafter the chopper members 14 can operate in a reversed orientation radially extending from the second staybar 12'.

The above principle has been utilised in the embodiment of the invention shown in FIGS. 5 and 6 according to which the shroud 2 has been provided with four recesses 6. With three or more series of chopper members 14 a very effective sweep of the sieve basket is attainable.

The fastening plates 8 and the spacers 18 are typically attached to the shroud 2 by welding carried out from the hollow interior of the shroud 2 which is provided with suitable openings for this purpose. In order to facilitate the construction of the drum this could possibly be made from a number of segments, which are joined together by longitudinal welding for instance at the wing plates 16 at each side of the recesses 6.

Although various embodiments of the present invention have been shown and described in the preceding parts of the detailed description it is understood that a person skilled in the art may conceive other embodiments of the invention without departing from the scope of the invention as defined by the following claims.

The invention claimed is:

1. The rotor for a hammer- or chopper mill comprising:

a cylindrical shell structure forming a circumferential drum surface for rotation about the longitudinal axis through said cylindrical shell structure, said circumferential drum surface comprising at least one recess for accommodation of pivotally mounted chopper members, wherein said at least one recess each being formed to accommodate a plurality of base portions for pivotally mounting a plurality of chopper members, and provided longitudinally extending in the cylindrical shell structure and in said at least one recess are provided chopper positioning means for attachment and/or lateral stabilization of said base portions of said chopper members and for stable accommodation of shaft members for pivotable attachment of said chopper members.

2. The rotor according to claim 1, wherein said at least one recess extends longitudinally over the entire length of said drum surface.

3. The rotor according to claim 1, wherein said shaft members is replaced by gudgeons laterally extending from the corresponding chopper positioning means.

4. The rotor according to claim 1, wherein said cylindrical shell structure is made from a comparatively thin sheet material.

5. The rotor according to claim 1, wherein said cylindrical shell structure is stabilized partly by means of said at least one recess and partly by means of appropriate fastening connections to a central drive shaft.

6. The rotor according to claim 1, wherein said cylindrical shell structure is stabilized partly by means of said at least one recess and partly by means of fastening connections to a central drive shaft formed by longitudinally extending radial wing plates.

7. The rotor according to claim 1, wherein the width of said at least one recess is sufficient to allow said chopper members, when these are provided with inner and outer apertures at either longitudinal end hereof, to be rotated to a position substantially tangential to the outer surface of the cylindrical shell structure in which position said outer apertures are aligned with apertures for reception of a second one of the shaft members.

8. The rotor according to claim 1, wherein said chopper members in one of said at least one recess are arranged longitudinally displaced relative to chopper members in other of said at least one recess for attaining a substantially complete sweep of the surface area of a sieve basket surrounding said rotor.

* * * * *